US005722691A

United States Patent [19]

Patel

[11] Patent Number: 5,722,691

[45] Date of Patent: Mar. 3, 1998

[54] COLLAPSIBLE AND PORTABLE PAGE HOLDER DEVICE FOR BOOKS

[76] Inventor: Tejal Patel, 515 Mullica Hill Rd., Apt. C-122, Glassboro, N.J. 08028

[21] Appl. No.: 604,108

[22] Filed: Feb. 20, 1996

[51] Int. Cl.[6] ..... B42D 9/00

[52] U.S. Cl. ..... 281/42; 281/45

[58] Field of Search ..... 281/42, 45; 248/448

[56] References Cited

U.S. PATENT DOCUMENTS

| | | | |
|---|---|---|---|
| 3,061,969 | 11/1962 | Lunday . | |
| 3,335,467 | 8/1967 | Freed | 281/42 X |
| 3,674,231 | 7/1972 | Lewis | 281/45 |
| 3,999,252 | 12/1976 | Bianco . | |
| 4,285,532 | 8/1981 | Davis | 281/45 |
| 4,462,614 | 7/1984 | Krause | 281/42 |
| 4,474,383 | 10/1984 | Kikis | 281/42 X |
| 4,726,606 | 2/1988 | D'Alessandro | 281/42 |
| 5,102,087 | 4/1992 | Brunell | 281/45 |
| 5,120,014 | 6/1992 | Chou | 281/45 X |
| 5,375,885 | 12/1994 | Abercrombie | 281/45 X |
| 5,382,054 | 1/1995 | Bettiol | 281/42 |

FOREIGN PATENT DOCUMENTS

| | | | |
|---|---|---|---|
| 343781 | 12/1904 | France | 281/42 |
| 2052389 | 1/1981 | United Kingdom | 281/45 |
| 2055691 | 3/1981 | United Kingdom | 281/45 |
| 89/07051 | 8/1989 | WIPO | 281/45 |

*Primary Examiner*—Frances Han
*Attorney, Agent, or Firm*—Ezra Sutton, Esq.

[57] ABSTRACT

A collapsible and portable page holder device for holding the pages of a book, including a back support member for supporting a book thereon having a hinge about which two equally sized sections are foldable, a channel opening formed in each of the back support sections of the back support member, and an adjustable holding clip having upper and lower clip members mounted within the channel opening in each of the back support sections. The adjustable holding clip has means for biasing the clips to a closed gripping position for gripping and holding the pages of a book. Each adjustable holding clip has a guide member having a guide shaft attached to each of the lower clip members for slidably moving each holding clip within each of the channel openings and relative to the back support member to adjust the spacing of the holding clips for receiving different size books.

12 Claims, 4 Drawing Sheets

COLLAPSIBLE AND PORTABLE PAGE HOLDER DEVICE FOR BOOKS

FIELD OF THE INVENTION

This invention relates to an improved collapsible page holder device for holding a book in an open position for reading, and more particularly, this device has a center hinge for folding portability and storage.

BACKGROUND OF THE INVENTION

Page holding devices for books, pamphlets, magazines, sheet music, manuals and the like have taken many forms in relation to appearance, functionality, shape, and material of construction. Generally, various types of support structures have been utilized to mount a book and the like securely for ease of reading with the desired effect of keeping the book opened at a specific page. Typically, this is done so that the book can be read while cooking, eating, traveling, or where a person's hands are otherwise occupied. In addition, the reader can turn the pages of the book periodically without much difficulty using only one hand.

There remains a need for a collapsible and portable page holder device that is compact and light-weight for transporting in the user's pocket, hand bag, knap-sack, brief case and the like. When in the collapsed mode it presents a small configuration for ease of portability; and when in the operational mode the page holder device can be adjusted to the desired size to be used with books (large and small), magazines, pamphlets, sheet music, newspapers, and the like.

DESCRIPTION OF THE PRIOR ART

Prior art page holding devices for books, magazines, pamphlets, and sheet music have been constructed in various ways with regard to appearance, functionality, shape, and materials of construction. For example, U.S. Pat. No. 401,662 discloses a sheet music support having spring clips mounted in slidable tracks with a non-movable center clip. This prior art structure does not disclose a sheet music support member foldable by a center hinge, nor are the clips transparent for holding the sheet music in place.

U.S. Pat. No. 3,061,969 discloses an adjustable book holder having a base that is adjustable for width, and has a pair of permanently mounted clips attached to the base. This prior art book holder does not disclose a foldable base using a center hinge, nor clips being slidably mounted on a track for accommodating different book widths.

U.S. Pat. No. 3,986,232 discloses a book page holder having an elongated back member that is adapted to extend across the back of a book, and a pair of clips being integrally attached to the back member. The clips are used to hold the pages of the book in place. This prior art book page holder does not disclose a foldable back member using a center hinge, nor does the back member have a slidable track for moving the clips to adjust to different book widths.

U.S. Pat. No. 4,767,094 discloses a book holder that includes an elongated planar member having strip segments which are adjustable relative to each other to accommodate larger or smaller books and to make the book holder smaller for ease of carrying. Clear holding tabs extend around and overlap the pages of a book and hold them in place. This prior art book holder does not disclose a planar member being foldable by a center hinge, nor does this book holder use spring clips to hold the book pages in place.

U.S. Pat. No. 5,102,087 discloses a page support apparatus for supporting sheet music having spring clamp members that are slidably mounted along a slot of the mounting plate. This prior art page support apparatus does not disclose a foldable base or back member using a center hinge.

None of the prior art patents disclose the combination of a page holder device for books having a two-sectional back support member being foldable by a center hinge and having spring-biased, adjustable holding clips mounted on a slidable track. Such structure appears to be structurally different from the prior art patents. Also, these prior art patents do not disclose a page holder device which is completely collapsible by folding into a small compact configuration for easy carrying or storage by the user.

Accordingly, it is an object of the present invention to provide a collapsible and portable page holder device which is light-weight and easily collapsed into a small compact configuration for ease of carrying and/or storage.

Another object of the present invention is to provide a collapsible and portable page holder device having adjustable holding clips mounted in slidable-track channels for adjusting to the required width of a book, magazine, newspaper, pamphlet, etc. such that the holding clips keep the pages held in place.

Another object of the present invention is to provide a collapsible and portable page holder device having a two-sectional back support member being foldable by a center hinge.

Another object of the present invention is to provide a collapsible and portable page holder device that is made from a transparent/clear, light-weight, and durable plastic such that the user is able to read all of the printed matter at the edges of each page.

A further object of the present invention is to provide a collapsible and portable page holder device that can be mass produced in an automated and economical manner and is readily affordable by the user.

SUMMARY OF THE INVENTION

In accordance with the present invention, there is provided an improved collapsible and portable page holder device for holding the pages of a book, having a back support member for supporting a book thereon which includes a hinge about which there are the two equally sized sections that are foldable. There is also a channel opening formed in each of the back support sections of the back support member. In addition, there is an adjustable holding clip having upper and lower clip members mounted within each of the channel openings in each of the back support sections. Each adjustment holding clip has means for biasing the clips to a closed gripping position for gripping and holding the pages of a book. There is also a guide member having a guide shaft attached to each of the lower clip members for slidably moving each holding clip within each of the channel openings and relative to the back support member to adjust the spacing of the holding clips for receiving different size books. The page holder device is made of transparent, durable, light weight plastic or a metal material for ease of portability. The page holder device can also be used for magazines, pamphlets, newspapers, sheet music and the like. The page holder device in the collapsed state can easily be stored in the user's pocket, hand bag, knap-sack, brief case and the like.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE PREFERRED EMBODIMENT

Figure 1:
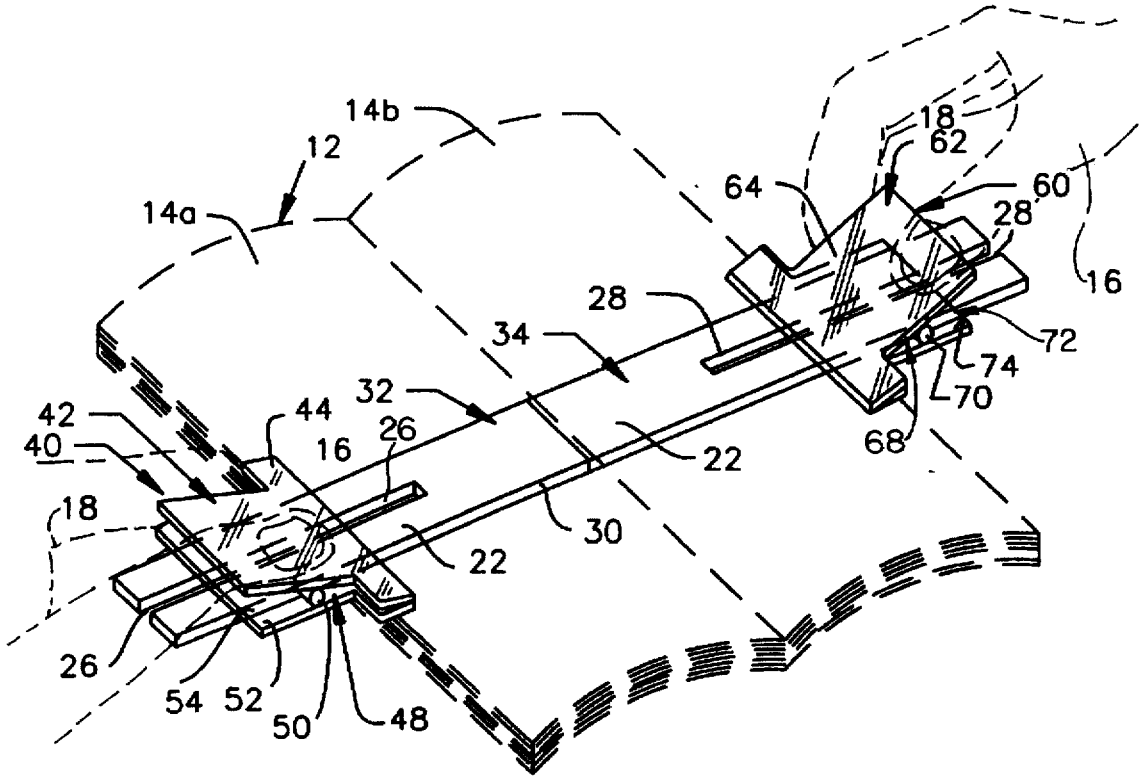
FIG. 1 is a top perspective view of the preferred embodiment of the present invention showing a page holder device holding pages of a book in place using adjustable holding clips.
Figure 2:
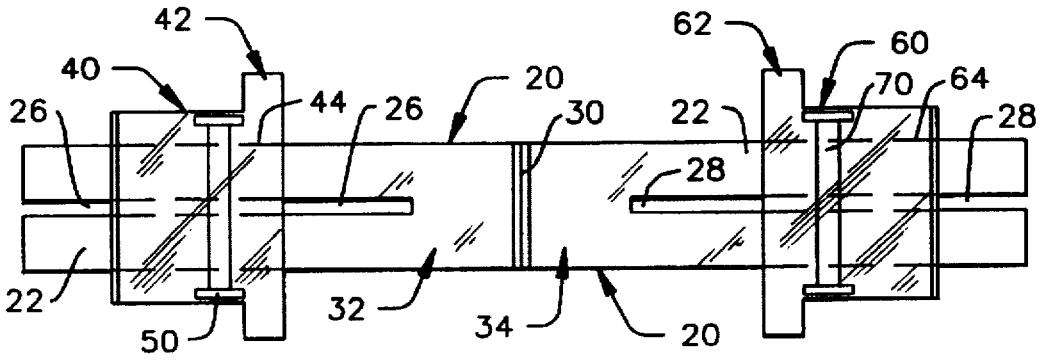
FIG. 2 is a top plan view of the present invention showing the support base member with slide-track channels, a pair of adjustable holding clips and a center hinge.
Figure 3:
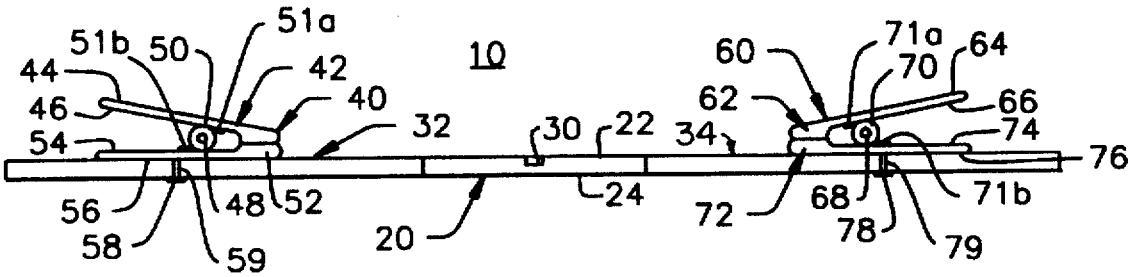
FIG. 3 is a side elevational view of the present invention showing the adjustable holding clips having upper and lower clip members with a biased spring integrally attached to the upper and low clip members with the holding clips being mounted on the support base member.
Figure 4:
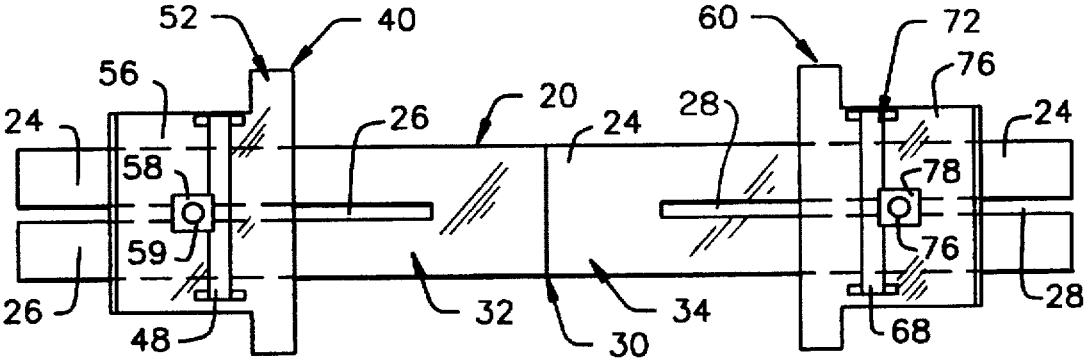
FIG. 4 is a bottom plan view of the present invention showing the support base member with slide-track channels, a pair of adjustable holding clips, and a guide member inserted within each slide-track channel.
Figure 5:
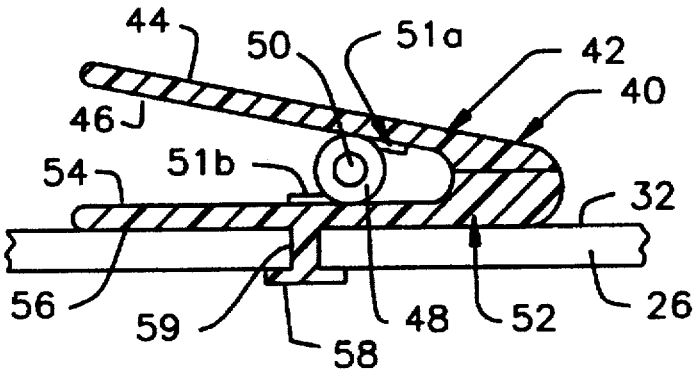
FIG. 5 is a cross-sectional view of the present invention taken along lines B—B of FIG. 1 showing an adjustable holding clip having the guide member with a guide shaft within the slide-track channel.
Figure 6:
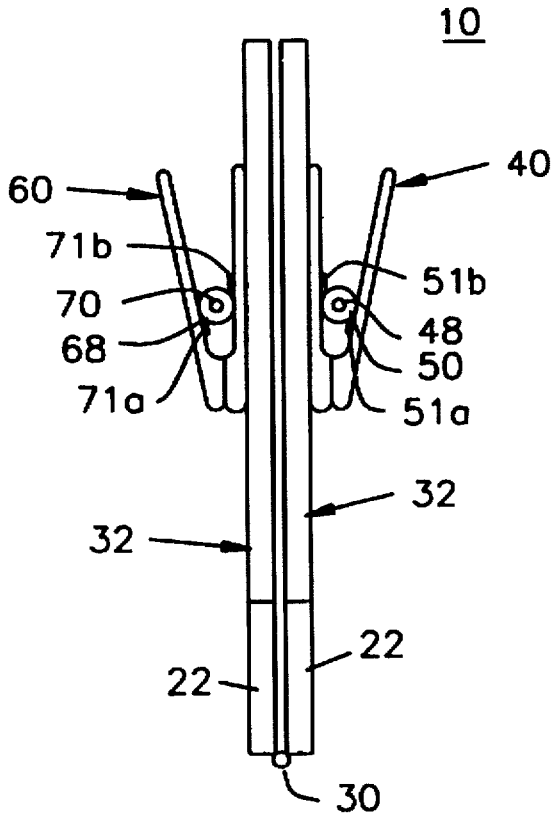
FIG. 6 is a side elevational view of the present invention showing a collapsed and compact configuration of the page holder device with the base support sections adjacent to each other.
Figure 7:
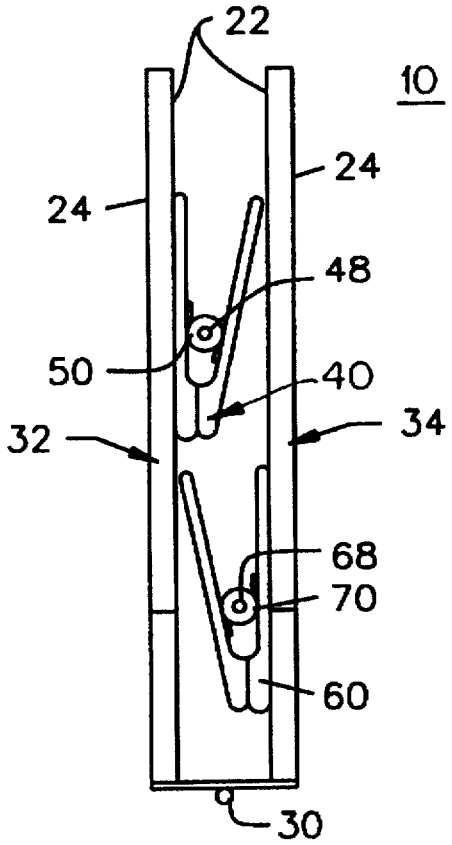
FIG. 7 is a side elevational view of the present invention showing a collapsed and compact configuration of the page holder device with the adjustable holding clips adjacent and in line with each other.

The preferred embodiment of the present invention provides for a collapsible, portable page holder device 10, as represented in FIGS. 1 to 7. FIG. 1 shows the page holder device 10 in a fully opened position and in an operational mode which has a book 12 opened with pages 14*a* and 14*b* being held in place by adjustable holding clips 40 and 60. FIGS. 2, 3, and 4 also show the page holder device 10 in a fully opened position. FIG. 5 shows the guide member 58 and guide shaft 59 within slide-channel track 26. FIGS. 6 and 7 show the page holder device 10 in a collapsed state and in a compact configuration for ease of portability, and ready to be put in a coat pocket, hand bag, knap-sack, or the like. The collapsible, portable page holder device 10 includes an elongated rectangular mounting support member 20 having slide-track channel openings 26 and 28, and a pair of adjustable holdings clips 40 and 60 for holding the pages 14*a* and 14*b* of book 12 in place, as depicted in FIG. 1.

Mounting support member 20 has a rectangular shape having a top surface 22 and a bottom surface 24. Mounting support member 20 includes two spaced-apart, elongated, rectangular shaped slide-track channels 26 and 28 formed therein, on top surface 22, for mounting adjustable clips 40 and 60 within channels 26 an 28, respectively. Mounting support member 20 also includes a centrally located hinge 30 located along center line A—A, for folding mounting support member 20 into two equal halves or base support sections 32 and 34, as depicted in FIGS. 1 to 4 of the drawings. This gives the mounting support member 20 the ability to be folded into a small compact configuration, such that when the base support sections 32 and 34 are folded, they are adjacent to each other, as depicted in FIGS. 6 and 7.

Left adjustable holding clip 40 includes an upper clip member 42 having top and bottom surfaces 44 and 46, a lower clip member 52 having top and bottom surfaces 54 and 56, and a center biased spring 50. One end 51*a* of center biased spring 50 is integrally attached to the bottom surface 46 of upper clip member 42 and the other end 51*b* of the center biased spring 50 is integrally attached to the top surface 54 of lower clip member 52. This forms the fulcrum point 48 of the adjustable clip 40 which enables clip 40 to clasp a plurality of pages on book 12 and hold them in place. Lower clip member 52 further includes an integrally attached and centrally located guide member 58 with a guide shaft 59 being integrally attached to the bottom surface 56 of lower clip member 52. The guide member 58 with shaft 59 slides in channel 26 of base support section 32 which is used for adjusting the clip 40 to a given size of book 12, as shown in FIG. 1.

Right adjustable holding clip 60 also includes an upper clip member 62 having top and bottom surfaces 64 and 66, a lower clip member 72 having top and bottom surfaces 74 and 76, and a center biased spring 70. One end 71*a* of center biased spring 70 is integrally attached to the bottom surface 66 of upper clip member 62 and the other end 71*b* of the center biased spring 70 is integrally attached to the top surface 74 of lower clip member 72. This also forms the fulcrum point 68 of the adjustable clip 60 which enables clip 60 to clasp a plurality of pages on book 12 and hold them in place. Lower clip member 72 further includes an integrally attached and centrally located guide member 78 with a guide shaft 79 being integrally attached to the bottom surface 76 of lower clip member 72. The guide member 78 with shaft 79 slides in channel 28 of base support section 34 which is used for adjusting the clip 60 to a given size of book 12.

Support member 20, and adjustable holding clips 40 and 60 are made of durable, rigid, and clear plastic material. Springs 50 and 70 can be made of a flexible plastic or metal material. The physical measurements of the back support member 20 in a fully opened mode has an overall width measurement in the range of 1 to 3 inches; an overall length measurement in the range of 12 to 18 inches; and a thickness measurement in the range of 1/16 to 3/16 inches. The slide-track channel openings 26 and 28 within support sections 32 and 34 have a width opening of 3/16 to 1/4 inches and a length opening in the range of 4 to 8 inches. The adjustable holding clip members 42, 52, 62, and 72 of clips 40 and 60 have a width measurement in the range of 3/4 to 4 inches, a length measurement in the range of 1 to 5 inches, and a thickness measurement of 1/16 to 3/16 inches.

Detailed Description of Alternate Embodiments

Figure 10:
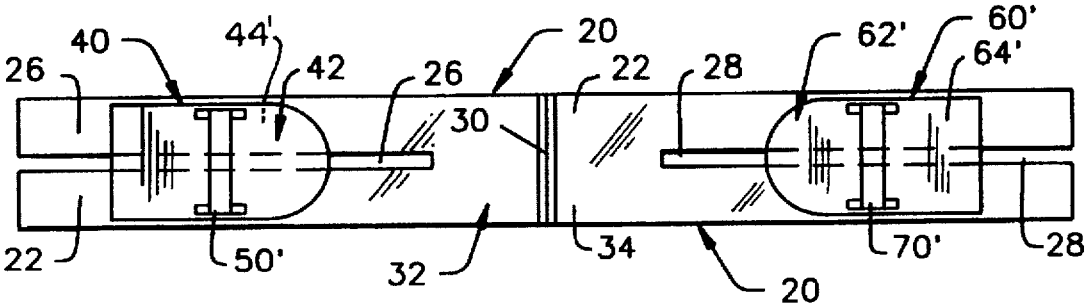
FIG. 10 is a top plan view of a third embodiment of the present invention showing a page holder device having the support base member with slide-track channels, a pair of adjustable holding clips and a center hinge.
Figure 8:
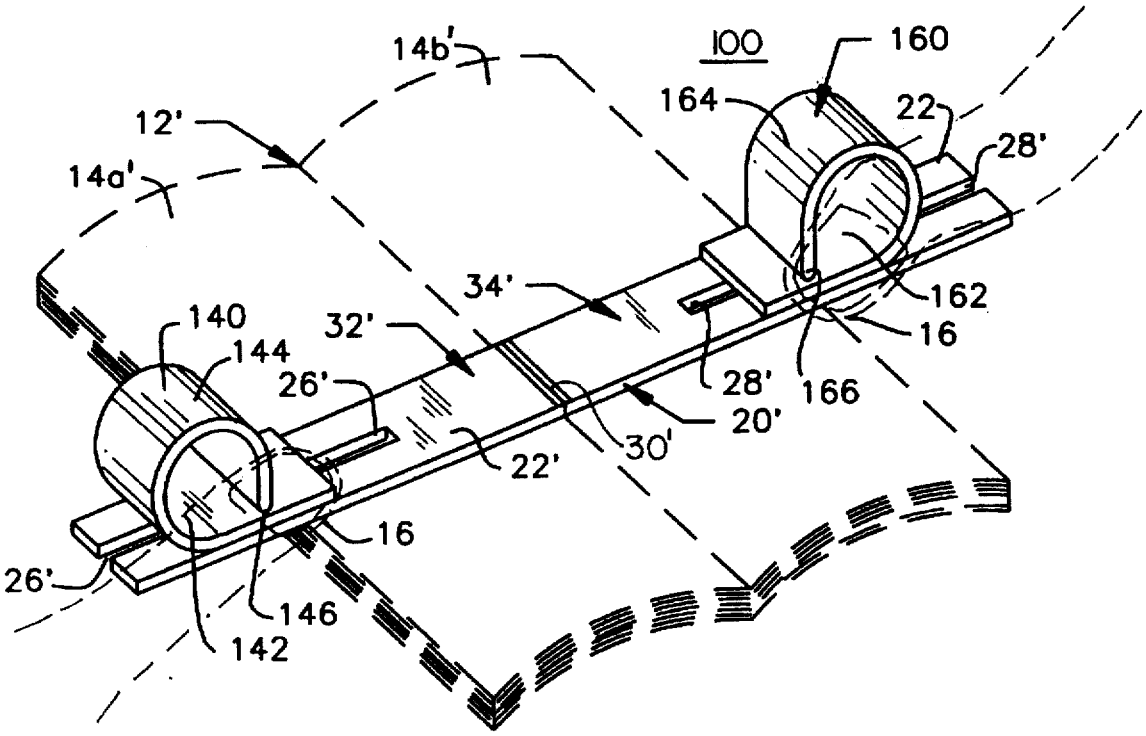
FIG. 8 is a top perspective view of a second embodiment of the present invention showing a page holder device holding pages of a book in place using adjustable curved holding clips.
Figure 9:
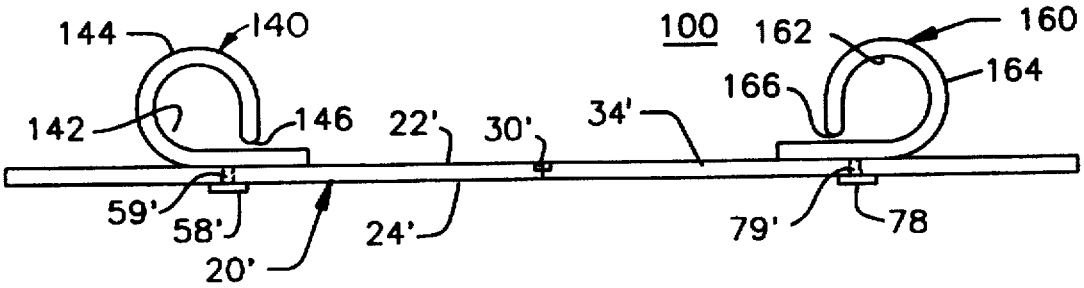
FIG. 9 is a side elevational view of the second embodiment of the present invention showing the adjustable curved holding clips mounted on the support base member.

Alternate embodiments 100 and 200 of the collapsible, portable page holder device 10 of the present invention are depicted in FIGS. 8, 9, and 10. All aspects of the alternate embodiments of the page holder devices 100 and 200 are the same as the preferred embodiment of the page holder device 10, except for the shape and size of the adjustable holding clips 140 and 160; and 40' and 60' which are different.

Second Embodiment

Left adjustable holding clip 140 has a curved shape and includes an inner surface 142, an outer surface 144 and a holding edge 146 for holding in place page 14*a*' of book 12'. Adjustable holding clip 140 further includes an integrally attached and centrally located guide member 148 with a guide shaft 150 being integrally attached to the outer surface 142 of clip 140. The guide member 148 with shaft 150 slides in channel 26' of base support section 32' which is used for adjusting the clip 140 to a given size of book 12', as shown in FIG. 8.

Right adjustable holding clip 160 also has a curved shape and includes an inner surface 162, an outer surface 164 and a holding edge 166 for holding in place page 14*b*' of book 12'. Adjustable holding clip 160 further includes an integrally attached and centrally located guide member 168 with a guide shaft 170 being integrally attached to the outer surface 162 of clip 160. The guide member 168 with shaft 170 slides in channel 28' of base support section 34' which is used for adjusting the clip 160 to a give size of book 12'.

Adjustable holding clips 140 and 160 are made of a durable, flexible, and clear plastic material which affords the user the ability to read any indicia on the edges of pages 14*a*' or 14*b*' of book 12'.

Third Embodiment

As shown in FIG. 10, the left adjustable holding clip 40' includes an upper clip member 42' having top and bottom surfaces 44' and 46'; a lower clip member 52' having top and bottom surfaces 54' and 56', and a center biased spring 50'.

Right adjustable holding clip 60' also includes an upper clip member 62' having top and bottom surfaces 64' and 66', a lower clip member 72' having top and bottom surfaces 74' and 76', and a center biased spring 70'.

The adjustable holding clips 40' and 60' are substantially rectangular in shape with the inner ends 48' and 68' being semi-circular in shape.

Operation of the Present Invention

The collapsible and portable page holder device 10 or 100 is readily put into operational use from a collapsed mode by initially unfolding base support sections 32, 32', 34, and 34' in a 90° degree angle at the hinge site 30 or 30', such that base support sections 32, 32', 34 and 34' are in a horizontal coplanar position. In this manner, the mounting support members 20 and 20' are in a horizontal mode, as depicted in FIGS. 1, 9, and 10 of the drawings.

Preferred Embodiment

The preferred embodiment of page holder device 10, after it is unfolded, is ready to receive a book 12, such that book 12 may be opened to a given set of pages, i.e. 14*a* and 14*b*. The user then sets the spine of book 12 in the general area of hinge 30 which rests on the mounting support member 20. Next, the user then places the thumb 16*l* of his/her left hand 18*l* on adjustable holding clip 40 and applies enough pressure on surface 44 of upper clip member 42 to adjust and move clip 40 within slide-channel track 26 to adjust for the width of page 14*a*. The bottom surface 46 of upper clip member 42 is then opened and placed on the edge of page 4*a* to hold it in place, as shown in FIG. 1. Conversely, the user then places the thumb 16*r* of his/her right hand 18*r* on adjustable holding clip 60 and applies enough pressure on surface 64 of upper clip member 62 to adjust and move clip 60 within slide-channel track 28 to adjust for the width of page 14*b*. The bottom surface 66 of upper clip member 62 is then opened and placed on the edge of page 14*b* to hold it in place. Pages 14*a* and 14*b* of book 12 now can be read, and when those pages 14*a* and 14*b* are read, the user then slips page 14*b* from clip 60 and places page 14*b* in clip 40 and proceeds to read the new pages 14*c* and 14*d* (not shown).

When the user is finished with reading book 12, the book 12 can then be removed from clips 40 and 60. Page holder device 10 is now ready to be collapsed by turning base support sections 32 and 34 inwardly 90° degrees at hinge point 30, such that the base support sections 32 and 34 are adjacent to each other as shown in FIG. 6. In an alternate method, page holder device 10 has a wider center hinge 30*a* that can be collapsed inwardly 90° degrees, as shown in FIG. 7, such that the upper clip member 42 of clip 40 is adjacent and touching base support section 34, and the upper clip member 62 of clip 60 is adjacent and touching base support section 32, as shown in FIG. 8. The collapsed page holder device 10 can now be put into the user's pocket, hand bag, knap-sack, brief case or the like as it is now in a small, compact configuration for ease of portability.

Second Embodiment

The alternate embodiment of the collapsible, portable page holder device 100, as depicted in FIGS. 8 and 9, functions in the same manner as the preferred embodiment of the page holder device 10, except for the manner of use of adjustable holding clips 140 and 160. When book 12' is placed on mounting support member 20', as in the preferred embodiment, the user then places his/her left thumb 161' of hand 181' on inner surface 142 of adjustable holding clip 140 and applies enough pressure to adjust and move clip 140 within slide-track channel 26' to adjust for the width of page 14*a*'. The user then lifts inner curved surface 142 vertically, such that clip edge 146 rests on the edge of page 14*a*' and holds it in place, as shown in FIG. 8. Conversely, the user then places his/her right thumb 16*r*' of hand 18*r*' on inner surface 162 of adjustable holding clip 160 and applies enough pressure to adjust and move clip 160 within slide-track channel 28' to adjust for the width of page 14*b*'. The user then lifts inner curved surface 162 vertically, such that clip edge 166 rests on the edge of page 14*b*' and holds it in place. The user can now read, hands-free, using alternate embodiment 100.

Third Embodiment

The third embodiment of the collapsible, portable page holder device 200, as depicted in FIG. 10, functions in the same manner as the preferred embodiment of the page holder device 10, except that adjustable holding clips 40' and '60 for holding book 12' in place are of a different shape.

ADVANTAGES OF THE PRESENT INVENTION

Accordingly, an advantage of the present invention is that it provides a collapsible and portable page holder device which is light-weight and easily collapsed into a small compact configuration for ease of carrying and/or storage.

Another advantage of the present invention is that it provides a collapsible and portable page holder device having adjustable holding clips mounted in slidable-track channels for adjusting to the required width of a book.

magazine, newspaper, pamphlet, etc. such that the holding clips keep the pages held in place.

Another advantage of the present invention is that it provides a collapsible and portable page holder device having a two-sectional back support member being foldable by a center hinge.

Another advantage of the present invention is that it provides a collapsible and portable page holder device that is made from a transparent/clear, light-weight, and durable plastic such that the user is able to read all of the printed matter at edges of each page.

A further advantage of the present invention is that it provides a collapsible and portable page holder device that can be mass produced in an automated and economical manner and is readily affordable by the user.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A collapsible and portable page holder device for holding the pages of a book, comprising:

a) a back support member for supporting a book thereon including two sections connected by a central hinge member about which said two sections are foldable;

b) an elongated, channel opening formed in each of said two sections of said back support member;

c) two adjustable holding clips each having upper and lower clip members wherein each of said lower clip members is mounted within said channel opening in each of said two sections;

d) means for biasing said holding clips to a closed gripping position for gripping and holding the pages of a book; and e) a guide member having guide means attached to each of said lower clip members for movably sliding each of said holding clips within each of said channel openings and relative to said back support member to adjust the spacing of said holding clips for receiving different size books.

2. A page holder device in accordance with claim 1, wherein each section of said back support member is in the shape of an elongated, narrow plastic strip.

3. A page holder device in accordance with claim 1, wherein said adjustable holding clip is in the shape of a rectangular, a "T" or a square.

4. A page holder device in accordance with claim 1, wherein said means for biasing said adjustable holding clip is a metal or plastic spring.

5. A page holder device in accordance with claim 1, wherein said adjustable holding clip is in the shape of a curved, open-ended, spring-biased, plastic ring for holding a page in place.

6. A page holder device in accordance with claim 1, wherein said page holder device is made of a transparent, durable plastic, or metal.

7. A page holder device in accordance with claim 1, wherein said page holder device can be used for holding pamphlets, magazines, booklets, or newspapers.

8. A page holder device in accordance with claim 1, wherein said adjustable holding clip is formed of a transparent, durable plastic.

9. A page holder device in accordance with claim 1, wherein said back support member is formed of metal.

10. A page holder device in accordance with claim 1, wherein said back support member in a fully opened position has an overall width measurement in the range of 1 to 3 inches; an overall length measurement in the range of 8 to 18 inches; and a thickness measurement in the range of 1/16 to 3/16 inches.

11. A page holder device in accordance with claim 1, wherein each of said channel openings within said support member has a width in the range of 3/16 to 1/4 inches and an overall length in the range of 4 to 8 inches.

12. A page holder device in accordance with claim 1, wherein each of said adjustable holding clips has a width measurement in the range of 3/4 to 4 inches; a length measurement in the range of 1 to 5 inches; and a thickness measurement in the range of 1/16 to 3/16 inches.

* * * * *